US010450805B2

(12) United States Patent
Bomidi et al.

(10) Patent No.: US 10,450,805 B2
(45) Date of Patent: Oct. 22, 2019

(54) ROTATABLE CUTTING ELEMENTS INCLUDING ROLLING-ELEMENT BEARINGS AND RELATED EARTH-BORING TOOLS AND METHODS

(71) Applicant: Baker Hughes, a GE company, LLC, Houston, TX (US)

(72) Inventors: John Abhishek Raj Bomidi, Spring, TX (US); Jon David Schroder, The Woodlands, TX (US); William A. Moss, Jr., Conroe, TX (US); Alexander Rodney Boehm, Wheat Ridge, CO (US); Kegan L. Lovelace, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 214 days.

(21) Appl. No.: 15/663,515

(22) Filed: Jul. 28, 2017

(65) Prior Publication Data

US 2019/0032413 A1 Jan. 31, 2019

(51) Int. Cl.

| | |
|---|---|
| ***E21B 10/55*** | (2006.01) |
| ***E21B 10/567*** | (2006.01) |
| ***E21B 10/54*** | (2006.01) |
| ***E21B 10/43*** | (2006.01) |

(52) U.S. Cl.

CPC ..... *E21B 10/54* (2013.01); *E21B 10/43* (2013.01)

(58) Field of Classification Search

CPC ..... E21B 10/55; E21B 10/564; E21B 10/567; E21B 10/573; E21B 10/627; E21B 10/633; E21B 2010/545; E21B 2010/561

See application file for complete search history.

(56) References Cited

U.S. PATENT DOCUMENTS

| | | | |
|---|---|---|---|
| 4,316,515 | A | 2/1982 | Pessier |
| 4,553,615 | A | 11/1985 | Grainger |
| 4,751,972 | A | 6/1988 | Jones et al. |
| 7,604,073 | B2 | 10/2009 | Cooley et al. |
| 7,703,559 | B2 | 4/2010 | Shen et al. |
| 7,762,359 | B1 | 7/2010 | Miess |
| 7,845,436 | B2 | 12/2010 | Cooley et al. |
| 7,987,931 | B2 | 8/2011 | Cooley et al. |
| 8,061,452 | B2 | 11/2011 | Cooley et al. |
| 8,079,431 | B1 | 12/2011 | Cooley et al. |
| 8,091,655 | B2 | 1/2012 | Shen et al. |

(Continued)

OTHER PUBLICATIONS

International Written Opinion for International Application No. PCT/US2018/043709 dated Nov. 29, 2018, 6 pages.

(Continued)

*Primary Examiner* — Kenneth L Thompson

(74) *Attorney, Agent, or Firm* — TraskBritt

(57) ABSTRACT

Rotatable cutting elements for earth-boring tools may include a substrate and a polycrystalline, superabrasive material secured to an end of the substrate. A sleeve may be sized and shaped to circumferentially surround at least a portion of the substrate. Rollers may be sized and shaped for positioning between, and making rolling contact with, the substrate and the sleeve, the rollers configured to rotate relative to the substrate and the sleeve and to enable the substrate to rotate relative to the sleeve. The rollers may be configured to bear at least radial forces acting on the substrate and the sleeve.

18 Claims, 7 Drawing Sheets

(56) References Cited

U.S. PATENT DOCUMENTS

| | | | |
|---|---|---|---|
| 8,210,285 | B2 | 7/2012 | Cooley et al. |
| 8,413,746 | B2 | 4/2013 | Shen et al. |
| 8,561,728 | B2 | 10/2013 | Cooley et al. |
| 8,800,691 | B2 | 8/2014 | Shen et al. |
| 8,881,849 | B2 | 11/2014 | Shen et al. |
| 8,931,582 | B2 | 1/2015 | Cooley et al. |
| 8,950,516 | B2 | 2/2015 | Newman |
| 8,973,684 | B1 | 3/2015 | Cooley et al. |
| 8,991,523 | B2 | 3/2015 | Shen et al. |
| 9,016,409 | B2 | 4/2015 | Zhang et al. |
| 9,033,070 | B2 | 5/2015 | Shen et al. |
| 9,187,962 | B2 | 11/2015 | Burhan et al. |
| 9,279,294 | B1 | 3/2016 | Cooley et al. |
| 9,291,000 | B2 | 3/2016 | Zhang et al. |
| 9,322,219 | B2 | 4/2016 | Burhan et al. |
| 9,328,564 | B2 | 5/2016 | Zhang et al. |
| 9,382,762 | B2 | 7/2016 | Cooley et al. |
| 9,388,639 | B2 | 7/2016 | Patel et al. |
| 9,464,486 | B2 | 10/2016 | Zhang et al. |
| 9,803,427 | B1 * | 10/2017 | Cooley ..... E21B 10/62 |
| 2002/0153175 | A1 | 10/2002 | Ojanen |
| 2007/0278017 | A1 | 12/2007 | Shen et al. |
| 2008/0017419 | A1 | 1/2008 | Cooley et al. |
| 2008/0251293 | A1 | 10/2008 | Mumma et al. |
| 2013/0140094 | A1 | 6/2013 | Burhan et al. |
| 2013/0146367 | A1 | 6/2013 | Zhang et al. |
| 2014/0054094 | A1 | 2/2014 | Burhan et al. |
| 2014/0131118 | A1 | 5/2014 | Chen et al. |
| 2014/0318873 | A1 | 10/2014 | Patel et al. |
| 2014/0326515 | A1 | 11/2014 | Shi et al. |
| 2014/0326516 | A1 | 11/2014 | Haugvaldstad et al. |
| 2014/0360789 | A1 | 12/2014 | Siracki et al. |
| 2014/0360792 | A1 | 12/2014 | Azar et al. |
| 2015/0047910 | A1 | 2/2015 | Chen et al. |
| 2016/0290056 | A1 | 10/2016 | Propes et al. |

OTHER PUBLICATIONS

International Search Report for International Application No. PCT/US2018/043709 dated Nov. 29, 2018, 3 pages.

* cited by examiner

ROTATABLE CUTTING ELEMENTS INCLUDING ROLLING-ELEMENT BEARINGS AND RELATED EARTH-BORING TOOLS AND METHODS

FIELD

This disclosure relates generally to rotatable cutting elements for earth-boring tools. More specifically, disclosed embodiments relate to rotatable cutting elements for earth-boring tools that may reduce friction and increase freedom of rotation.

BACKGROUND

Earth-boring tools may include cutting elements secured to bodies of the earth-boring tools. The cutting elements may be secured at least partially within pockets extending into the bodies of the earth-boring tools. When the earth-boring tools are rotated under an applied load, the cutting elements may be driven into and remove an underlying earth formation. Some attempts have been made to render the cutting elements rotatable relative to the bodies within the pockets.

BRIEF SUMMARY

In some embodiments, rotatable cutting elements for earth-boring tools may include a substrate and a polycrystalline, superabrasive material secured to an end of the substrate. A sleeve may be sized and shaped to circumferentially surround at least a portion of the substrate. Rollers may be sized and shaped for positioning between, and making rolling contact with, the substrate and the sleeve, the rollers configured to rotate relative to the substrate and the sleeve and to enable the substrate to rotate relative to the sleeve. The rollers may be configured to bear at least radial forces acting on the substrate and the sleeve.

In other embodiments, earth-boring tools may include a body and at least one rotatable cutting element secured to the body. The at least one rotatable cutting element may include a substrate and a polycrystalline, superabrasive material secured to an end of the substrate. A sleeve may circumferentially surround at least a portion of the substrate, the sleeve at least partially located within a pocket extending into the body. The sleeve may be secured to the body within the pocket. Rollers may be located between, and in rolling contact with, the substrate and the sleeve. The rollers may be configured to rotate relative to the substrate and the sleeve and to enable the substrate to rotate relative to the sleeve, the rollers configured to bear at least radial forces acting on the substrate and the sleeve.

In still other embodiments, methods of using rotatable cutting elements may involve contacting a cutting face of a superabrasive, polycrystalline material secured to an end of a substrate against an earth material. The substrate may rotate about an axis of rotation in response to contacting the cutting face against the earth material. Rollers may rotate relative to the substrate, the rollers in rolling contact with the substrate and with a sleeve circumferentially surrounding at least a portion of the substrate. The rollers may bear at least radial forces acting on the substrate and the sleeve.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular earth-boring tool, rotatable cutting element, or component thereof, but are merely idealized representations employed to describe illustrative embodiments. Thus, the drawings are not necessarily to scale.

Disclosed embodiments relate generally to rotatable cutting elements for earth-boring tools that may reduce friction and increase freedom of rotation. More specifically, disclosed are embodiments of rotatable cutting elements for earth-boring tools that may include rotatable cutting elements including roller bearings enabling the rotatable cutting elements to rotate within the respective pockets of the earth-boring tools to which the rotatable cutting elements are secured.

As used in this specification, the terms "substantially" and "about" in reference to a given parameter, property, or condition means and includes to a degree that one skilled in the art would understand that the given parameter, property, or condition is met with a small degree of variance, such as within acceptable manufacturing tolerances. For example, a parameter that is substantially or about a specified value or condition may be at least about 90% the specified value or condition, at least about 95% the specified value or condition, or even at least about 99% the specified value or condition.

The term "earth-boring tool," as used herein, means and includes any type of bit or tool used for drilling during the formation or enlargement of a wellbore in a subterranean formation. For example, earth-boring tools include fixed-cutter bits, core bits, eccentric bits, bi-center bits, reamers, mills, hybrid bits including both fixed and rotatable cutting structures, and other drilling bits and tools known in the art.

As used herein, the term "superabrasive material" means and includes any material having a Knoop hardness value of about 3,000 $Kg_f/mm^2$ (29,420 MPa) or more. Superabrasive materials include, for example, diamond and cubic boron nitride. Superabrasive materials may also be characterized as "superhard" materials.

As used herein, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "inter-bonded" mean and include any direct atomic bond (e.g., covalent, metallic, etc.) between atoms in adjacent grains of superabrasive material.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

Figure 1:
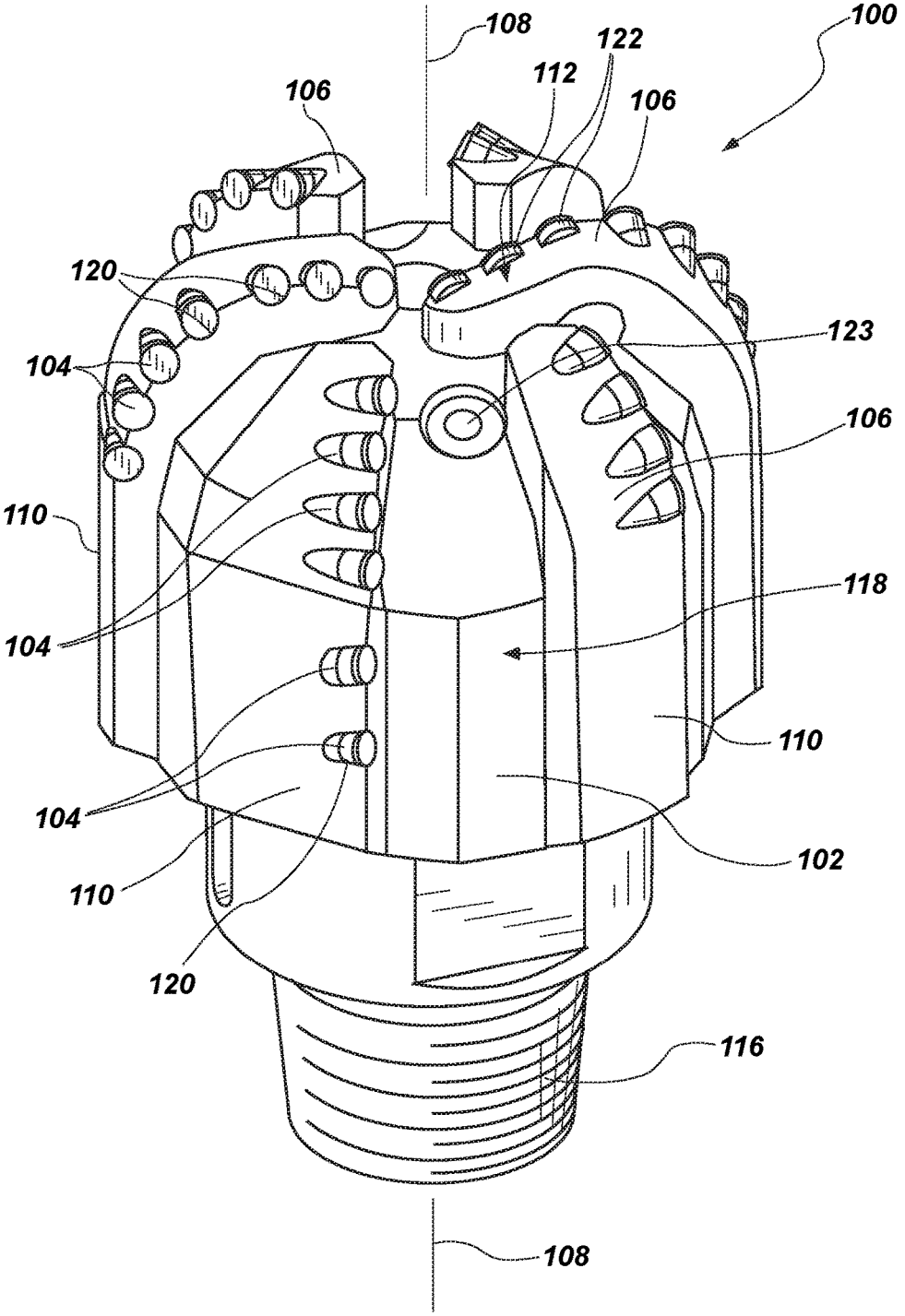
FIG. 1 is a perspective view of an earth-boring tool having at least one rotatable cutting element secured thereto.

Referring to FIG. 1, a perspective view of an earth-boring tool 100 is shown. The earth-boring tool 100 may include a body 102 having at least one rotatable cutting element 104 secured thereto. The earth-boring tool 100 depicted in FIG. 1 is configured as a bladed, rotary drill bit having cutting elements secured to the blades thereof, but other configurations for earth-boring tools may be employed with rotatable cutting elements 104 in accordance with this disclosure. The body 102 of the earth-boring tool 100 may include, for example, blades 106 extending outward from a remainder of the body 102, with junk slots 118 located rotationally between the blades 106. The blades 106 may extend radially outward from proximate to an axis of rotation 108 of the earth-boring tool 100 to a gage region 110 at an outer diameter of the body 102. The blades 106 may extend longitudinally from a face 112 of the body 102 at a leading end of the earth-boring tool 100, away from the face 112, toward a shank 116 at a trailing end of the earth-boring tool 100. The shank 116 may have a threaded connection portion, which may conform to industry standards (e.g., those promulgated by the American Petroleum Institute (API)), for attaching the earth-boring tool 100 to a drill string. The body 102 may include a material suitable for downhole use. For example, the body 102 may include a metal or metal alloy material (e.g., steel) or a particle-matrix composite material (e.g., particles of tungsten carbide located in a metal or metal alloy matrix).

Rotatable cutting elements 104 may be secured at least partially within pockets 120 extending from rotationally leading surfaces of a blade 106 into the blade 106. The rotatable cutting elements 104 may be secured to one, some, or all of the blades 106 of a given earth-boring tool 100. The rotatable cutting elements 104 may be configured to rotate within the pockets 120 as the rotatable cutting elements 104 are driven into, and remove, an underlying earth material during rotation of the earth-boring tool 100 under an applied load (e.g., weight-on-bit). Nozzles 123 located within the junk slots 118 may emit drilling fluid circulating through the drill string under pressure to remove cuttings from the rotatable cutting elements 104 and any stationary cutting elements 122 and carry the cuttings suspended in the drilling fluid to the surface. In some embodiments, such as that shown in FIG. 1, stationary cutting elements 122 that do not rotate within their respective pockets 120 may be secured to the same body 102 to which the rotatable cutting elements 104 are secured.

Figure 2:
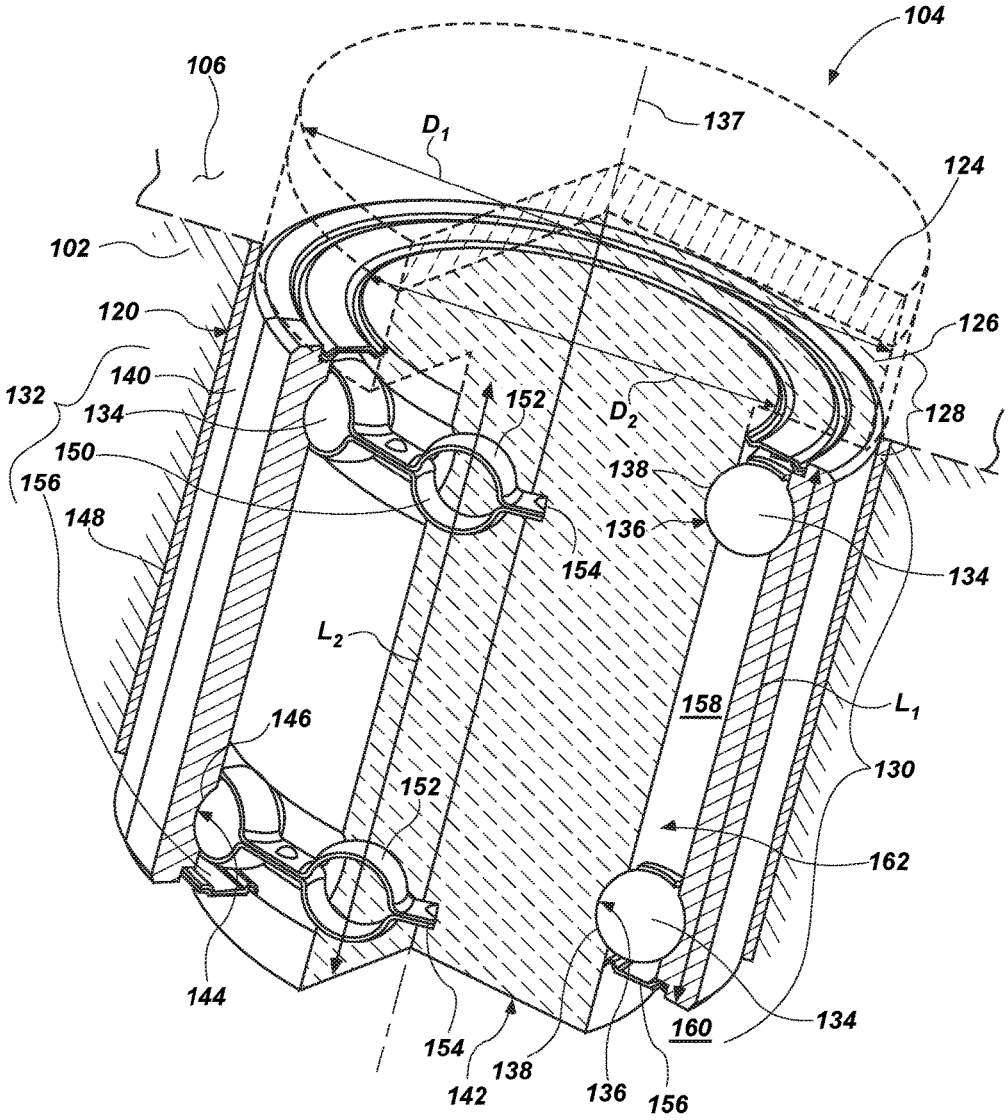
FIG. 2 is a partial cutaway perspective view of a rotatable cutting element usable with the earth-boring tool of FIG. 1.

FIG. 2 is a partial cutaway perspective view of a rotatable cutting element 104 usable with the earth-boring tool 100 of FIG. 1. The rotatable cutting element 104 may include a polycrystalline, superabrasive material 124 secured to an end of a substrate 126. The substrate 126 may include a first portion 128 exhibiting a first diameter $D_1$ and a second portion 130 exhibiting a second, smaller greatest diameter $D_2$. The polycrystalline, superabrasive material 124 may be located on the first portion 128, and the second portion 130 may be located on a side of the first portion 128 opposite the polycrystalline, superabrasive material 124. The polycrystalline, superabrasive material 124 and the first portion 128 of the substrate 126 are depicted in FIG. 2 transparently in dashed lines to more clearly show the underlying structures.

The rotatable cutting element 104 may be retained in the pocket 120 in which it is located, and at least radial loads acting on the rotatable cutting element 104 may be borne, by a rolling-element bearing 132. The rolling-element bearing 132 may include rollers 134 in rolling contact with the substrate 126 of the rotatable cutting element 104. The rolling-element bearing 132 shown in FIG. 2 may be configured as a ball bearing, and the rollers 134 may be spherical in shape and be free to rotate in any direction in response to rotational movement of the rotatable cutting element 104. The substrate 126 may include one or more grooves 136 extending from the second diameter $D_2$ radially into the substrate 126 within the second portion 130. As shown in FIG. 2, the rolling-element bearing 132 may include two grooves 136 at different longitudinal positions along an axis of rotation 137 of the rotatable cutting element 104, one closer to the polycrystalline, superabrasive material 124 and the other farther from the polycrystalline, superabrasive material 124, corresponding to two rows or sets of the rollers 134 aligned with those longitudinal positions. In other embodiments, the rolling-element bearing 132 may include one groove 136 or more than two grooves 136 (e.g., three, four, etc.), corresponding to one or more than two rows or sets of the rollers 134. A surface 138 of each groove 136 in contact with the rollers 134 may be arcuate in shape to increase an area of contact between the surface 138 and each roller 134 in embodiments where the rollers are also arcuate, such as that shown in FIG. 2. For example, the surface 138 of each groove 136 may be shaped as a portion of a circle extending around the axis of rotation 137 to exhibit an annular shape.

The rolling-element bearing 132 may further include a sleeve 140 surrounding the rollers 134 and at least some of the second portion 130 of the substrate 126. For example, the sleeve 140 may extend longitudinally from proximate to the first portion 128 of the substrate 126, along the second portion 130 of the substrate 126, toward an end 142 of the substrate 126 opposite the polycrystalline, superabrasive material 124. In some embodiments, such as that shown in FIG. 2, the end 142 of the substrate 126 may be located beyond the sleeve 140 when the rotatable cutting element 104 is rotatably secured to the sleeve 140, such that a first longitudinal length $L_1$ of the sleeve 140 may be less than a second longitudinal length $L_2$ of the second portion 130 as measured in a direction parallel to the axis of rotation 137. In some embodiments, the sleeve 140 may include two or more distinct components that are secured to one another around the remaining components of the rolling-element bearing 132 to enable assembly of the rolling-element bearing 132.

The sleeve 140 may include one or more grooves 144 extending from an inner surface 146 of the sleeve 140 radially outward into the sleeve 140. As shown in FIG. 2, the sleeve 140 may include two grooves 144 at different longitudinal positions along the axis of rotation 137 of the rotatable cutting element 104 aligned with the longitudinal positions of the grooves 136 in the substrate 126. A surface 146 of each groove 144 in contact with the rollers 134 may be arcuate in shape to increase an area of contact between the surface 146 and each roller 134 in embodiments where the rollers are also arcuate, such as that shown in FIG. 2. For example, the surface 146 of each groove 144 may be shaped as a portion of a circle extending around the axis of rotation 137 to exhibit an annular shape. The rollers 134 may be interposed between the substrate 126 and the sleeve 140, and may be in rolling contact with the surfaces 138 and 146 of the grooves 136 and 144 of the substrate 126 and the sleeve 140. As a result, the rollers 134 may transfer at least radial forces acting on the rotatable cutting element 104 (e.g., those forces acting in directions perpendicular to the axis of rotation 137) to the sleeve 140. In embodiments where the rollers 134 include surfaces, and the grooves 136 and 144 of the substrate 126 and the sleeve 140 include corresponding surfaces 138 and 146, oriented in directions other than parallel to the axis of rotation 137, such as the spherical rollers 134 and arcuate surfaces 138 and 144 shown in FIG. 2, the rolling-element bearing 132 may further bear axial forces acting on the rotatable cutting element 104 (e.g., those forces acting in directions parallel to the axis of rotation 137).

The sleeve 140 of the rolling-element bearing 132 may be directly secured to the body 102 of the earth-boring tool 100. For example, a braze material 148 may be located within the pocket 120 between the sleeve 140 and the material of the body 102 making up the blade 106. The braze material 148 may secure the sleeve 140 within the pocket 120, and mechanical interference between the sleeve 140, rollers 134, substrate 126, and optionally other components of the rolling-element bearing 132 may retain at least some of the second portion 130 of the substrate 126 of the rotatable cutting element 104 within the pocket 120.

In some embodiments, such as that shown in FIG. 2, the rolling-element bearing 132 may further include a cage 150 configured to maintain the rollers 134 at predetermined positions relative to one another. For example, the cage 150 may include retainers 152 partially surrounding each of the rollers 134, and connectors 154 extending between the retainers 152. The retainers 152 shown in FIG. 2 may be truncated hollow spheres exposing portions of the rollers 134 at radially inward and radially outward portions of the retainers 152 to place the rollers 134 in rolling contact with the surfaces 138 and 146 of the grooves 136 and 144 of the substrate 126 and the sleeve 140. The connectors 154 shown in FIG. 2 may include strips or bars of material extending circumferentially between adjacent retainers 152. The cage 150 may be formed, for example, by placing a first ring including first halves of the retainers 152 facing a first direction and first halves of the connectors 154 in contact with a second ring including second halves of the retainers 152 facing a second, opposite direction and second halves of the connectors 154 with the rollers 134 positioned between the first and second halves of the retainers 152, the first and second halves of the connectors 154 contacting one another. The halves of the connectors 154 may then be secured to one another (e.g., by riveting, welding, etc.), such that the rollers 134 may be held in place relative to one another by, but main remain free to rotate within, the cage 150. In other embodiments, rolling-element bearings in accordance with this disclosure may be configured as full complement bearings, lacking cages, and including a number of rollers 134 sufficient to at least substantially fill an entire circumference of the one or more grooves 136. For example, a diameter of the rollers 134 multiplied by a number of the rollers 134 may be between about 90% and about 99% of the circumference of the groove 136 as measured at a geometric center of the groove 136.

The rolling-element bearing 132 may include one or more sealing elements 156 positioned to seal an interior 158 of the sleeve 140 from an exterior 160 of the sleeve 140. For example, the rolling-element bearing 132 may include one sealing element 156 forming a seal at a first longitudinal end of the sleeve 140 proximate to the first portion 128 of the substrate 126 and another sealing element 156 forming a seal at a second longitudinal end of the sleeve 140 proximate to the end 142 of the second portion 130 of the substrate 126. The sealing elements 156 may reduce the extent to which contaminants from circulating drilling fluid may enter the interior 158 of the sleeve 140 during use, and the extent to which braze material 148 may enter the interior 158 of the sleeve 140 during brazing. In some embodiments, the sealing elements 156 may seal a lubricant 162 within the interior 158 of the sleeve 140. The lubricant 162 may include, for example, an oil-based or a silicone-based material. More specifically, the lubricant 162 may include mineral oils, synthetic oils, greases, and mixtures and combinations thereof, and such materials may be formulated with additives or modifiers to enhance the performance of the lubricant 162, such as, for example, to adapt the lubricant 162 for extreme pressure properties.

Figure 3:
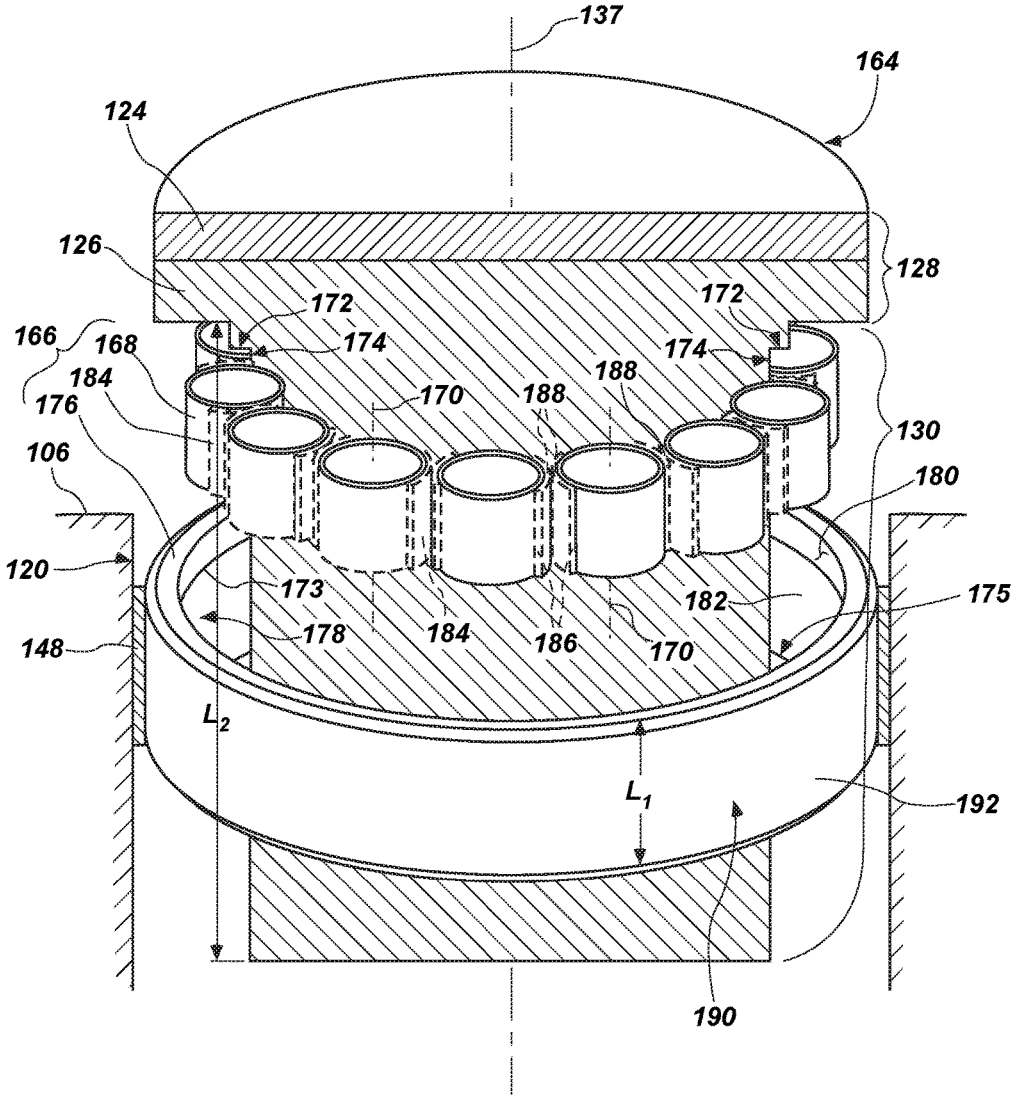
FIG. 3 is a partial cutaway perspective, partial cross-sectional exploded side view of another embodiment of a rotatable cutting element usable with the earth-boring tool of FIG. 1.

FIG. 3 is a partial cutaway perspective, partial cross-sectional, exploded side view of another embodiment of a rotatable cutting element 164 usable with the earth-boring tool 100 of FIG. 1. The rolling-element bearing 166 shown in FIG. 3 may be configured as a cylindrical bearing, and the rollers 168 may be cylindrical in shape and be free to rotate about their own respective axes of rotation 170 extending parallel to the axis of rotation 137 of the rotatable cutting element 164 in response to rotational movement of the rotatable cutting element 164. As also shown in FIG. 3, the substrate 126 may include one groove 172 configured to receive a row or set of the cylindrical rollers 168. A surface 174 of the groove 172 in contact with the rollers 168 may be cylindrical in shape and extend in a longitudinal direction parallel to the axis of rotation 137 of the rotatable cutting element 164. More specifically, the surface 174 of the groove 172 may be shaped as a line at least substantially parallel to the axis of rotation 137 and extending around the axis of rotation 137 to exhibit an annular shape. The groove 172 may further include a top surface 173 and a bottom surface 175 to constrain axial movement of the rollers 134.

The sleeve 176 may likewise include a single groove 178 extending from an inner surface 180 of the sleeve 176 radially outward into the sleeve 176. As shown in FIG. 3, the first longitudinal length $L_1$ of the sleeve 176 may be less than half the second longitudinal length $L_2$ of the second portion 130 of the substrate 126 as measured in a direction parallel to the axis of rotation 137. A surface 182 of the groove 178 in contact with the rollers 168 may be cylindrical in shape and extend in a longitudinal direction parallel to the axis of rotation 137 of the rotatable cutting element 164. More specifically, the surface 182 of the groove 178 may be shaped as a line at least substantially parallel to the axis of rotation 137 and extending around the axis of rotation 137 to exhibit an annular shape. The rollers 168 may be interposed between the substrate 126 and the sleeve 176, and may be in rolling contact with the surfaces 174 and 182 of the grooves 172 and 178 of the substrate 126 and the sleeve 176. As a result, the rollers 168 may transfer at least radial forces acting on the rotatable cutting element 164 to the sleeve 176.

The rolling-element bearing 166 may optionally include a cage 184 configured to maintain the rollers 168 at predetermined positions relative to one another. For example, the cage 184 may include retainers 186 partially surrounding each of the rollers 168, and connectors 188 extending between the retainers 186. The retainers 186 shown in FIG. 3 may be truncated hollow cylinders exposing portions of the rollers 168 at radially inward and radially outward portions of the retainers 186 to place the rollers 168 in rolling contact with the surfaces 174 and 182 of the grooves 172 and 178 of the substrate 126 and the sleeve 176. The connectors 188 shown in FIG. 3 may include direct connections between adjacent retainers 186 (e.g., the connectors 188 may be integrally formed with one another). The cage 184 may be formed, for example, by placing a pair of the retainers 186 between adjacent rollers 168, and securing the retainers 186, connectors 188, and rollers 168 in place by interposing them between the substrate 126 and the sleeve 176. In some embodiments, the sleeve 176 may include one or more slots 190 through which the rollers 168 and cage 184 may be inserted into the grooves 172 and 178 one-by-one until there is no longer room in the grooves 172 and 178 for additional rollers 168 and connected pairs of retainers 186, and which may subsequently be closed with one or more plugs 192, to enable assembly of the rolling-element bearing 132. The cage 184 shown in FIG. 3 is depicted in dashed lines to illustrate that it may be included or excluded, depending on whether the rolling-element bearing 166 is configured as a full complement bearing, lacking the cage 184, and including a number of rollers 168 sufficient to at least substantially fill an entire circumference of the groove 178.

Figure 4:
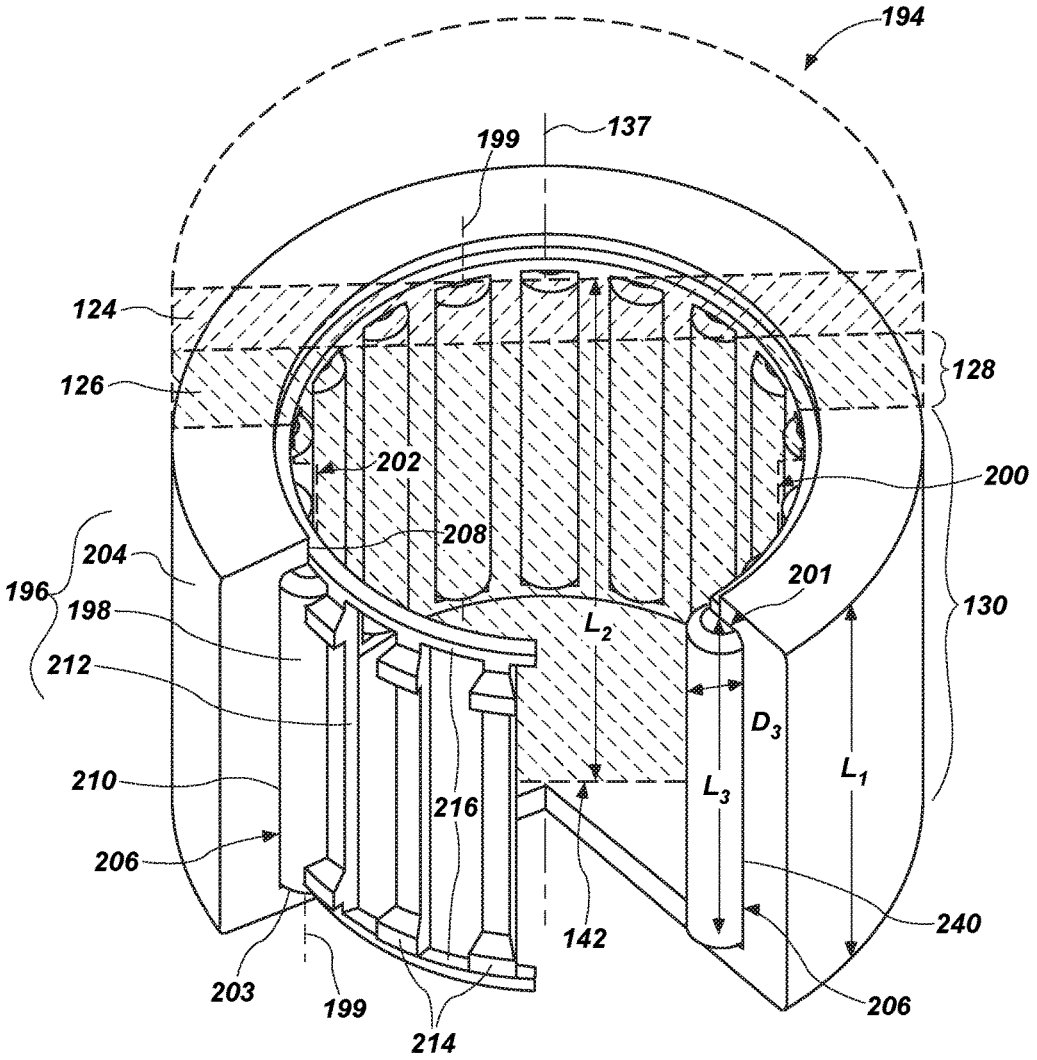
FIG. 4 is a partial cutaway, partial cross-sectional side view of yet another embodiment of a rotatable cutting element usable with the earth-boring tool of FIG. 1.

FIG. 4 is a partial cutaway perspective, partial cross-sectional side view of yet another embodiment of a rotatable cutting element 194 usable with the earth-boring tool 100 of FIG. 1. The rolling-element bearing 196 shown in FIG. 4 may be configured as a needle bearing, and the rollers 198 may be cylindrical in shape and be free to rotate about their own respective axes of rotation 199 extending parallel to the axis of rotation 137 of the rotatable cutting element 194 in response to rotational movement of the rotatable cutting element 194. A ratio of a third longitudinal length $L_3$ of a respective needle roller 198 to a third diameter $D_3$ of the respective needle roller 198 may be, for example, between about 3:1 and about 20:1. More specifically, the ratio of the third longitudinal length $L_3$ of the needle rollers 198 to the third diameter $D_3$ of the needle rollers 198 may be, for example, between about 5:1 and about 15:1.

As also shown in FIG. 4, the substrate 126 may include one groove 200 configured to receive a row or set of the needle rollers 198. A surface 202 of the groove 200 in contact with the rollers 198 may be cylindrical in shape and extend in a longitudinal direction parallel to the axis of rotation 137 of the rotatable cutting element 194. More specifically, the surface 202 of the groove 200 may be shaped as a line at least substantially parallel to the axis of rotation 137 and extending around the axis of rotation 137 to exhibit an annular shape. The groove 200 may further include a top surface 201 and a bottom surface 203 to constrain axial movement of the rollers 198.

The sleeve 204 may likewise include a single groove 206 extending from an inner surface 208 of the sleeve 204 radially outward into the sleeve 204. As shown in FIG. 4, the first longitudinal length $L_1$ of the sleeve 204 may be greater than the second longitudinal length $L_2$ of the second portion 130 of the substrate 126 as measured in a direction parallel to the axis of rotation 137. As a result, the sleeve 204 may circumferentially surround the side surfaces of the substrate 126 and may underlie the end 142 of the substrate 126 opposite the polycrystalline, superabrasive material 124. A surface 210 of the groove 200 in contact with the rollers 198 may be cylindrical in shape and extend in a longitudinal direction parallel to the axis of rotation 137 of the rotatable cutting element 194. More specifically, the surface 210 of the groove 200 may be shaped as a line at least substantially parallel to the axis of rotation 137, having a longitudinal length greater than or equal to the third longitudinal length $L_3$ of the rollers 198, and extending around the axis of rotation 137 to exhibit an annular shape. The rollers 198 may be interposed between the substrate 126 and the sleeve 204, and may be in rolling contact with the surfaces 202 and 210 of the grooves 200 and 206 of the substrate 126 and the sleeve 204. As a result, the rollers 198 may transfer at least radial forces acting on the rotatable cutting element 104 to the sleeve 204.

The rolling-element bearing 196 may further include a cage 212 configured to maintain the rollers 198 at predetermined positions relative to one another. For example, the cage 212 may include retainers 214 partially surrounding each of the rollers 198, and connectors 216 extending between the retainers 214. The retainers 214 shown in FIG. 4 may be brackets with curved side surfaces for engagement with the rollers 198, the retainers 214 exposing at least portions of the rollers 198 at radially inward and radially outward portions of the retainers 214 to place the rollers 198 in rolling contact with the surfaces 202 and 210 of the grooves 200 and 206 of the substrate 126 and the sleeve 204. The connectors 216 shown in FIG. 4 may include annular rails extending circumferentially between adjacent retainers 214 proximate to the longitudinal ends of the retainers 214.

Figure 5:
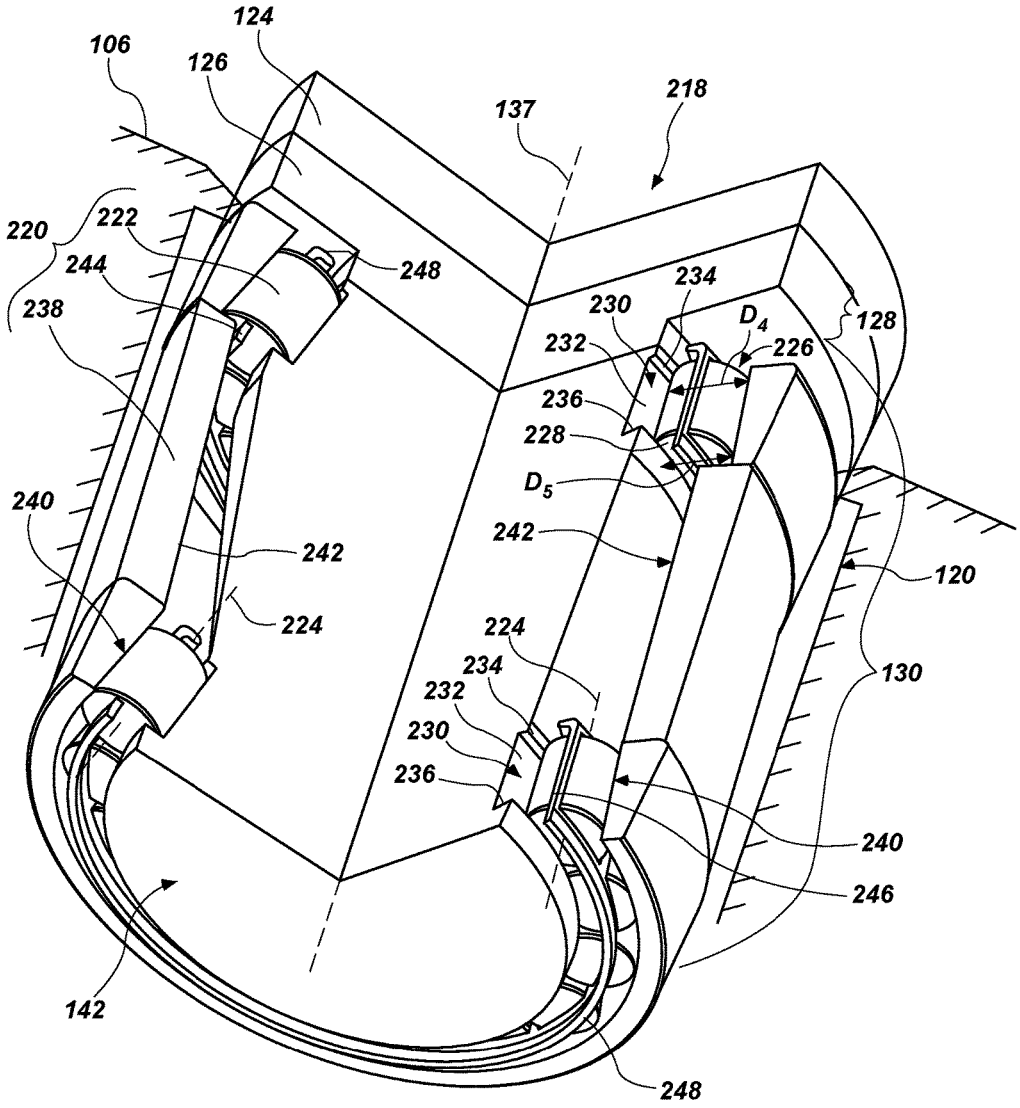
FIG. 5 is a partial cutaway, partial cross-sectional side view of still another embodiment of a rotatable cutting element usable with the earth-boring tool of FIG. 1.

FIG. 5 is a partial cutaway perspective view of still another embodiment of a rotatable cutting element 218 usable with the earth-boring tool of FIG. 1. The rolling-element bearing 220 shown in FIG. 5 may be configured as a tapered bearing, and the rollers 222 may be frustoconical in shape and be free to rotate about their own respective axes of rotation 224 extending at an oblique angle to the axis of rotation 137 of the rotatable cutting element 218 in response to rotational movement of the rotatable cutting element 218. A fourth diameter $D_4$ of each roller 222 at a first end 226 of the respective roller 222 located proximate to the polycrystalline, superabrasive material 124 may be less than the fifth diameter $D_5$ of each roller 222 at a second, opposite end 228 of the respective roller 222 located distal from the polycrystalline, superabrasive material 124. As also shown in FIG. 5, the substrate 126 may include multiple grooves 230 configured to receive corresponding rows or sets of the tapered rollers 222. Surfaces 232 of the grooves 230 in contact with the rollers 222 may be frustoconical in shape and extend in a longitudinal direction oblique to the axis of rotation 137 of the rotatable cutting element 218. More specifically, the surfaces 232 of the grooves 230 may be shaped as a line oblique to the axis of rotation 137, oriented such that a portion of the surfaces 232 proximate to the polycrystalline, superabrasive material 124 may be closer to the axis of rotation 137 than a portion of the surfaces 232 distal from the polycrystalline, superabrasive material 124, and extending around the axis of rotation 137 to exhibit a tapered, annular shape. The grooves 230 may further include top surfaces 234 and bottom surfaces 236 to constrain axial movement of the rollers 222.

The sleeve 238 may include multiple tapered surfaces 240 extending from an inner surface 242 of the sleeve 238 radially outward into the sleeve 238. The tapered surfaces 240 in contact with the rollers 222 may be frustoconical in shape and extend in a longitudinal direction oblique to the axis of rotation 137 of the rotatable cutting element 218.

More specifically, the tapered surfaces 240 of the sleeve 238 may be shaped as a line oblique to the axis of rotation 137, oriented such that a portion of the surfaces 240 proximate to the polycrystalline, superabrasive material 124 may be closer to the axis of rotation 137 than a portion of the surfaces 240 distal from the polycrystalline, superabrasive material 124, and extending around the axis of rotation 137 to exhibit an annular shape. The rollers 222 may be interposed between the substrate 126 and the sleeve 238, and may be in rolling contact with the surface 232 of the groove 230 of the substrate 126 and the surface 240 of the sleeve 238. As a result, the rollers 222 may transfer radial and axial forces acting on the rotatable cutting element 218 to the sleeve 238.

The rolling-element bearing 220 may further include a cage 244 configured to maintain the rollers 222 at predetermined positions relative to one another. For example, the cage 244 may include retainers 246 partially surrounding each of the rollers 222, and connectors 248 extending between the retainers 246. The retainers 246 shown in FIG. 5 may be pillars or columns for framing the rollers 222, the retainers 246 exposing at least portions of the rollers 222 at radially inward and radially outward portions of the retainers 246 to place the rollers 222 in rolling contact with the surface 232 of the groove 230 of the substrate 126 and the surface 240 of the sleeve 238. The connectors 248 shown in FIG. 5 may include annular rails extending circumferentially between adjacent retainers 246 proximate to the longitudinal ends of the retainers 246.

Figure 6:
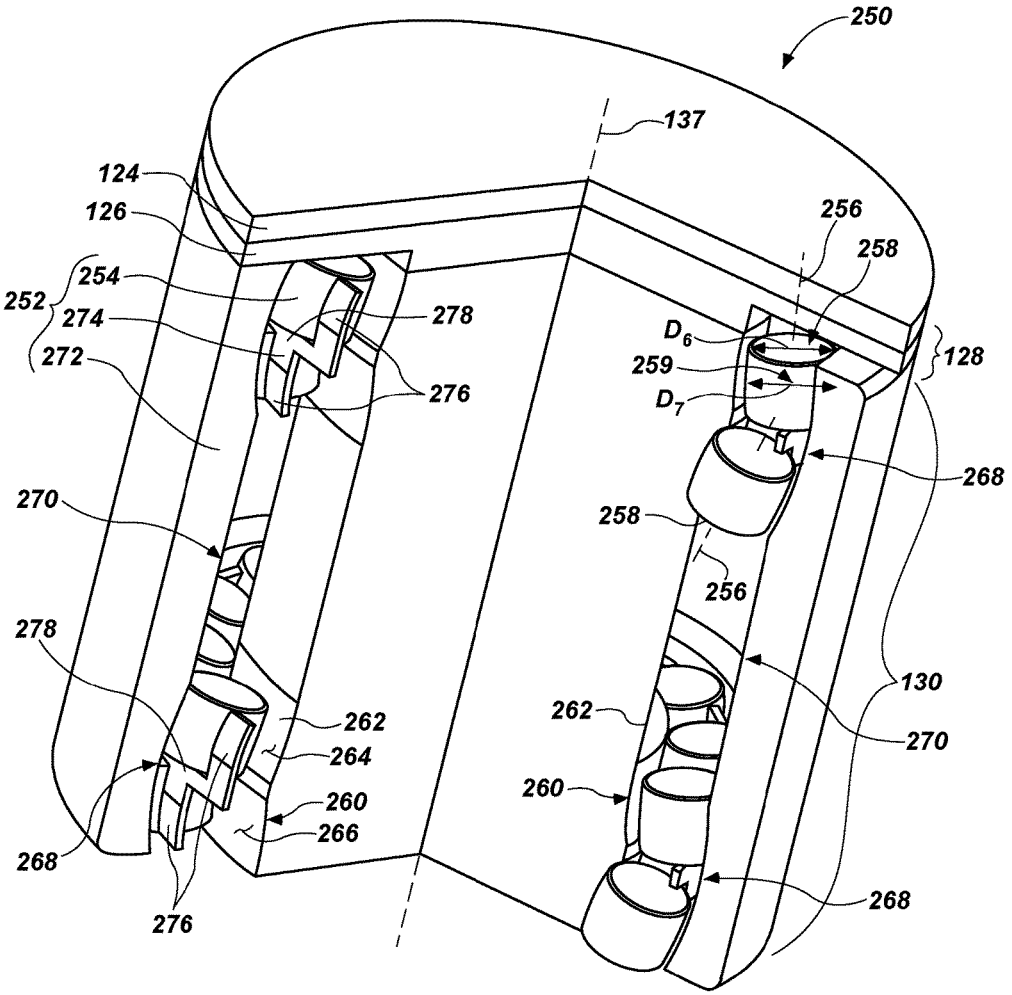
FIG. 6 is a partial cutaway, partial cross-sectional side view of another embodiment of a rotatable cutting element usable with the earth-boring tool of FIG. 1.

FIG. 6 is a partial cutaway perspective view of another embodiment of a rotatable cutting element 250 usable with the earth-boring tool of FIG. 1. The rolling-element bearing 252 shown in FIG. 6 may be configured as a spherical bearing, and the rollers 254 may be generally barrel-shaped and be free to rotate about their own respective axes of rotation 256 extending at oblique angles to the axis of rotation 137 of the rotatable cutting element 250 in response to rotational movement of the rotatable cutting element 250. A sixth diameter $D_6$ of each roller 254 at the ends 258 of the respective roller 254, which may be in the form of parallel planes, may be less than the seventh diameter $D_7$ of each roller 254 at a midpoint along the axis of rotation 256 of the respective roller 254, and the side surface of the roller 254 extending between the ends 258 and the midpoint 259 may be arcuate (e.g., may exhibit a spherical curvature). Each row or set of rollers 254 may include two subgroups in the embodiment shown in FIG. 6: one in which the axis of rotation 256 is oriented at an acute angle clockwise from the axis of rotation 137 of the substrate 126 and another in which the axis of rotation 256 is oriented at an obtuse angle as measured clockwise from the axis of rotation 137 of the substrate 126. Such a configuration may better enable the rolling-element bearing 252 to bear loads acting in both axial directions, toward and away from the polycrystalline, superabrasive material 124 as viewed from the substrate 126.

As also shown in FIG. 6, the substrate 126 may include multiple grooves 260 configured to receive corresponding rows or sets of the spherical rollers 254. Surfaces 262 of the grooves 260 in contact with the rollers 254 may be arcuate in shape and extend in longitudinal directions oblique to the axis of rotation 137 of the rotatable cutting element 250. More specifically, each groove 260 may include a first arcuate surface 264, a line formed by a least squares fit to the surface 264 and coplanar with the axis of rotation 137 of the rotatable cutting element 250 may form an obtuse angle with the axis of rotation 137 as measured clockwise therefrom, and a second arcuate surface 266, a line formed by a least squares fit to the surface 266 and coplanar with the axis of rotation 137 of the rotatable cutting element 250 may form an obtuse angle with the axis of rotation 137 as measured clockwise therefrom, each of which may be in contact with a respective subgroup of the rollers 254.

The sleeve 272 may include multiple arcuate surfaces 268 extending from an inner surface 270 of the sleeve 204 radially outward into the sleeve 272. The arcuate surfaces 268 in contact with the rollers 254 may be sections of circles rotated about the axis of rotation 137 of the rotatable cutting element 250 to form an annular shape, and the first subgroup of rollers 254 may be in rolling contact with an upper portion of the surface 268 while the second subgroup of rollers 254 may be in rolling contact with a lower portion of the surface 268. The rollers 254 may be interposed between the substrate 126 and the sleeve 272, and may be in rolling contact with the surfaces 264 and 266 of the groove 260 of the substrate 126 and the surface 268 of the sleeve 272. As a result, the rollers 254 may transfer radial and axial forces acting on the rotatable cutting element 250 to the sleeve 272.

The rolling-element bearing 252 may further include a cage 274 configured to maintain the rollers 254 at predetermined positions relative to one another. For example, the cage 274 may include retainers 276 partially surrounding each of the rollers 254, and connectors 278 extending between the retainers 276. The retainers 276 shown in FIG. 6 may be slats extending circumferentially adjacent to the rollers 254, the retainers 276 exposing at least portions of the rollers 254 at radially inward and radially outward portions of the retainers 276 to place the rollers 254 in rolling contact with the surfaces 264 and 266 of the groove 260 of the substrate 126 and the surface 268 of the sleeve 272. The connectors 278 shown in FIG. 6 may include an annular rail extending circumferentially between adjacent retainers 276 between the longitudinal ends of the retainers 246 and between the subgroups of the rollers 254.

Figure 7:
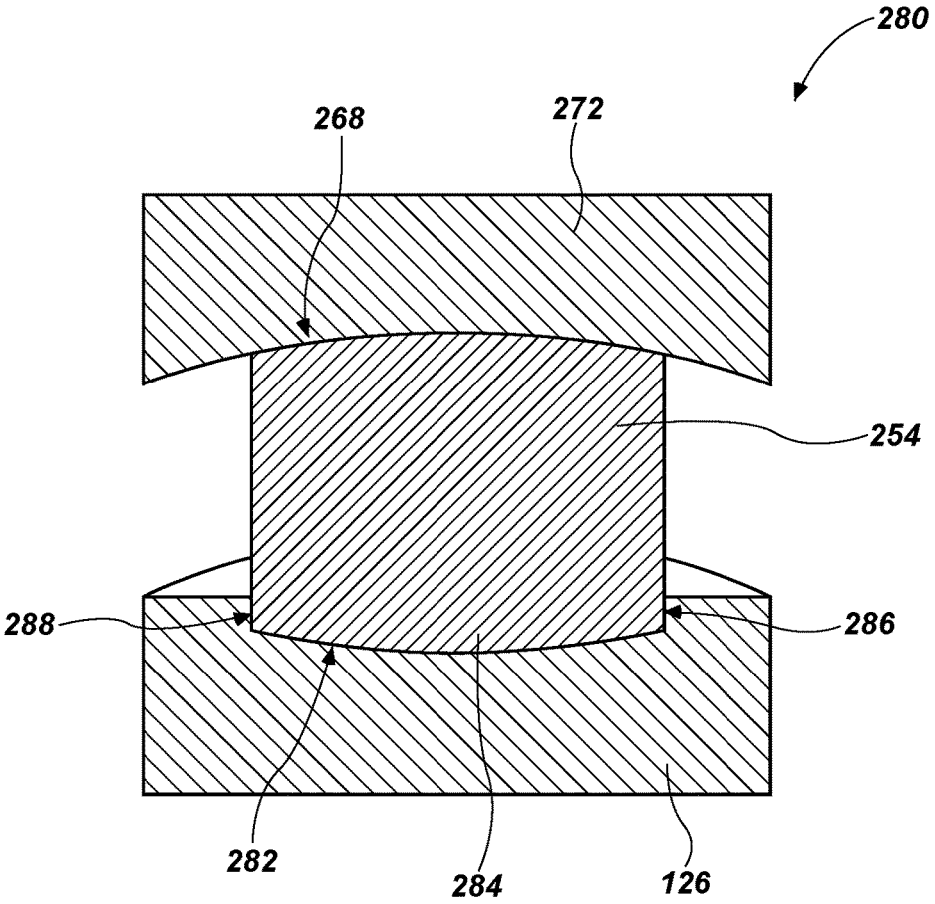
FIG. 7 is a cross-sectional view of a portion of another embodiment of a rotatable cutting element similar to that of FIG. 6.

FIG. 7 is a cross-sectional view of a portion of another embodiment of a rotatable cutting element similar to that of FIG. 6. In some embodiments in which the rotating-element bearing 280 is configured as a spherical bearing, the spherical rollers 254 may not be divided into subgroups. Rather, there may be a single group in a row or set of the rollers 254. In such embodiments, the sleeve 272 may be configured as described previously in connection with FIG. 6. The groove 282 in the substrate 126 may include a surface 284 in contact with the rollers 254 which may be arcuate in shape and extend in a longitudinal direction at least substantially parallel to the axis of rotation 137 of the rotatable cutting element 250 (see FIG. 6). More specifically, the groove 282 may include an arcuate surface 284, a line formed by a least squares fit to the surface 284 and coplanar with the axis of rotation 137 of the rotatable cutting element 250 may extend at least substantially parallel to the axis of rotation 137. The groove 282 may further include a top surface 286 and a bottom surface 288 to constrain axial movement of the rollers 254.

The foregoing figures depict various features for rotatable cutting elements, and should not be considered separate embodiments that are not combinable with one another, but illustrative feature configurations that may be intermixed with one another to produce rotatable cutting elements in accordance with this disclosure. For example, the roller shapes and corresponding contact surface shapes, numbers of rows of rollers, designs for roller cages, methods of assembly, presence or absence of certain features (e.g., the sealing element) may be selectively combined with one another in various configurations to produce rotatable cutting elements as contemplated by the inventors.

Additional, nonlimiting embodiments within the scope of this disclosure include the following:

Embodiment 1

A rotatable cutting element for an earth-boring tool, comprising: a substrate; a polycrystalline, superabrasive material secured to an end of the substrate; a sleeve sized and shaped to circumferentially surround at least a portion of the substrate; and rollers sized and shaped for positioning between, and making rolling contact with, the substrate and the sleeve, the rollers configured to rotate relative to the substrate and the sleeve and to enable the substrate to rotate relative to the sleeve, the rollers configured to bear at least radial forces acting on the substrate and the sleeve.

Embodiment 2

The rotatable cutting element of Embodiment 1, wherein a surface of the sleeve in contact with the rollers is at least substantially cylindrical.

Embodiment 3

The rotatable cutting element of Embodiment 2, wherein the rollers are cylindrical, such that each roller is rotatable about a respective axis of rotation during rotation of the substrate.

Embodiment 4

The rotatable cutting element of Embodiment 3, wherein the rollers comprise needle rollers, a ratio of a longitudinal length of a respective needle roller to a diameter of the respective needle roller being between about 3:1 and about 20:1.

Embodiment 5

The rotatable cutting element of Embodiment 1, wherein a surface of the sleeve in contact with the rollers is tapered relative to an axis of rotation of the substrate, such that the sleeve and rollers are configured to bear axial and radial forces acting on the substrate and the sleeve.

Embodiment 6

The rotatable cutting element of Embodiment 5, wherein the rollers comprise tapered rollers, a diameter of each roller at a first end of the respective roller located proximate to the superabrasive, polycrystalline material being less than the diameter of each roller at a second, opposite end of the respective roller located distal from the superabrasive, polycrystalline material.

Embodiment 7

The rotatable cutting element of Embodiment 1, wherein a surface of the sleeve in contact with the rollers is arcuate relative to an axis of rotation of the substrate, such that the sleeve and rollers are configured to bear axial and radial forces acting on the substrate and the sleeve.

Embodiment 8

The rotatable cutting element of Embodiment 7, wherein the rollers are spherical, such that the rollers are free to rotate in any direction during rotation of the substrate.

Embodiment 9

The rotatable cutting element of Embodiment 7, wherein the rollers include arcuate side surfaces in contact with the surface of the sleeve, a diameter of each roller at ends thereof being less than the diameter of each roller at a midpoint along an axis of rotation thereof.

Embodiment 10

The rotatable cutting element of Embodiment 9, wherein surfaces of the rollers at the end thereof are parallel planes.

Embodiment 11

The rotatable cutting element of Embodiment 9, wherein the arcuate surface of the sleeve and the arcuate side surfaces of the rollers exhibit a spherical curvature.

Embodiment 12

The rotatable cutting element of Embodiment 1, further comprising sealing elements forming seals at longitudinal ends of the sleeve, the seals inhibiting fluid flow between a space defined within the sleeve by surfaces of the sleeve, substrate, rollers, and cage and a space located outside the sleeve.

Embodiment 13

The rotatable cutting element of Embodiment 12, further comprising a lubricant sealed within the space defined within the sleeve by surfaces of the sleeve, substrate, rollers, and cage.

Embodiment 14

The rotatable cutting element of Embodiment 1, further comprising a cage sized and shaped to partially surround each of the rollers, the cage configured to retain the rollers in position between the substrate and the sleeve.

Embodiment 15

An earth-boring tool, comprising: a body; and at least one rotatable cutting element secured to the body, the at least one rotatable cutting element comprising: a substrate; a polycrystalline, superabrasive material secured to an end of the substrate; a sleeve circumferentially surrounding at least a portion of the substrate, the sleeve at least partially located within a pocket extending into the body, the sleeve secured to the body within the pocket; and rollers located between, and in rolling contact with, the substrate and the sleeve, the rollers configured to rotate relative to the substrate and the sleeve and to enable the substrate to rotate relative to the sleeve, the rollers configured to bear at least radial forces acting on the substrate and the sleeve.

Embodiment 16

A method of using a rotatable cutting element, comprising: contacting a cutting face of a superabrasive, polycrystalline material secured to an end of a substrate against an earth material; rotating the substrate about an axis of rotation in response to contacting the cutting face against the earth material; and rotating rollers relative to the substrate, the rollers being in rolling contact with the substrate and with a sleeve circumferentially surrounding at least a portion of the substrate, the rollers bearing at least radial forces acting on the substrate and the sleeve.

Embodiment 17

The method of Embodiment 16, wherein rotating rollers relative to the substrate comprises rotating tapered rollers about the substrate, the tapered rollers being in rolling contact with a tapered surface of the sleeve relative to an axis of rotation of the substrate.

Embodiment 18

The method of Embodiment 16, wherein rotating rollers relative to the substrate comprises rotating rollers having arcuate side surfaces about the substrate, the rollers being in rolling contact with an arcuate surface of the sleeve relative to an axis of rotation of the substrate.

Embodiment 19

The method of Embodiment 16, further comprising inhibiting fluid flow between a space defined within the sleeve by surfaces of the sleeve, substrate, rollers, and cage and a space located outside the sleeve utilizing sealing elements forming seals at longitudinal ends of the sleeve.

Embodiment 20

The method of Embodiment 16, further comprising retaining the rollers in position between the substrate and the sleeve utilizing a cage partially surrounding each of the rollers.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A rotatable cutting element for an earth-boring tool, comprising:

a substrate;

a polycrystalline, superabrasive material secured to an end of the substrate;

a sleeve sized and shaped to circumferentially surround at least a portion of the substrate;

rollers sized and shaped for positioning between, and making rolling contact with, the substrate and the sleeve, the rollers configured to rotate relative to the substrate and the sleeve and to enable the substrate to rotate relative to the sleeve, the rollers configured to bear at least radial forces acting on the substrate and the sleeve, and a cage sized and shaped to partially surround each of the rollers, the cage configured to retain the rollers in position between the substrate and the sleeve.

2. The rotatable cutting element of claim 1, wherein a surface of the sleeve in contact with the rollers is at least substantially cylindrical.

3. The rotatable cutting element of claim 2, wherein the rollers are cylindrical, such that each roller is rotatable about a respective axis of rotation during rotation of the substrate.

4. The rotatable cutting element of claim 3, wherein the rollers comprise needle rollers, a ratio of a longitudinal length of a respective needle roller to a diameter of the respective needle roller being between about 3:1 and about 20:1.

5. The rotatable cutting element of claim 1, wherein a surface of the sleeve in contact with the rollers is tapered relative to an axis of rotation of the substrate, such that the sleeve and rollers are configured to bear axial and radial forces acting on the substrate and the sleeve.

6. The rotatable cutting element of claim 5, wherein the rollers comprise tapered rollers, a diameter of each roller at a first end of a respective roller located proximate to the polycrystalline, superabrasive material being less than the diameter of each roller at a second, opposite end of the respective roller located distal from the polycrystalline, superabrasive material.

7. The rotatable cutting element of claim 1, wherein a surface of the sleeve in contact with the rollers is arcuate relative to an axis of rotation of the substrate, such that the sleeve and rollers are configured to bear axial and radial forces acting on the substrate and the sleeve.

8. The rotatable cutting element of claim 7, wherein the rollers are spherical, such that the rollers are free to rotate in any direction during rotation of the substrate.

9. The rotatable cutting element of claim 7, wherein the rollers include arcuate side surfaces in contact with the surface of the sleeve, a diameter of each roller at ends thereof being less than the diameter of each roller at a midpoint along an axis of rotation thereof.

10. The rotatable cutting element of claim 9, wherein surfaces of the rollers at the end thereof are parallel planes.

11. The rotatable cutting element of claim 9, wherein the arcuate side surface of the sleeve and the arcuate side surfaces of the rollers exhibit a spherical curvature.

12. The rotatable cutting element of claim 1, further comprising sealing elements forming seals at longitudinal ends of the sleeve, the seals inhibiting fluid flow between a space defined within the sleeve by surfaces of the sleeve, substrate, rollers, and cage and a space located outside the sleeve.

13. The rotatable cutting element of claim 12, further comprising a lubricant sealed within the space defined within the sleeve by surfaces of the sleeve, substrate, rollers, and cage.

14. An earth-boring tool, comprising:

a body; and at least one rotatable cutting element secured to the body, the at least one rotatable cutting element comprising:

a substrate;

a polycrystalline, superabrasive material secured to an end of the substrate;

a sleeve circumferentially surrounding at least a portion of the substrate, the sleeve at least partially located within a pocket extending into the body, the sleeve secured to the body within the pocket;

rollers located between, and in rolling contact with, the substrate and the sleeve, the rollers configured to rotate relative to the substrate and the sleeve and to enable the substrate to rotate relative to the sleeve, the rollers configured to bear at least radial forces acting on the substrate and the sleeve; and a cage sized and shaped to partially surround each of the rollers, the cage configured to retain the rollers in position between the substrate and the sleeve.

15. A method of using a rotatable cutting element, comprising:

contacting a cutting face of a superabrasive, polycrystalline material secured to an end of a substrate against an earth material;

rotating the substrate about an axis of rotation in response to contacting the cutting face against the earth material;

rotating rollers relative to the substrate, the rollers being in rolling contact with the substrate and with a sleeve circumferentially surrounding at least a portion of the substrate, the rollers bearing at least radial forces acting on the substrate and the sleeve; and retaining the rollers in position between the substrate and the sleeve utilizing a cage partially surrounding each of the rollers.

16. The method of claim 15, wherein rotating rollers relative to the substrate comprises rotating tapered rollers about the substrate, the tapered rollers being in rolling contact with a tapered surface of the sleeve relative to an axis of rotation of the substrate.

17. The method of claim 15, wherein rotating rollers relative to the substrate comprises rotating rollers having arcuate side surfaces about the substrate, the rollers being in rolling contact with an arcuate surface of the sleeve relative to an axis of rotation of the substrate.

18. The method of claim 15, further comprising inhibiting fluid flow between a space defined within the sleeve by surfaces of the sleeve, substrate, rollers, and cage and a space located outside the sleeve utilizing sealing elements forming seals at longitudinal ends of the sleeve.

* * * * *